US010153604B1

(12) United States Patent
Hsu

(10) Patent No.: US 10,153,604 B1
(45) Date of Patent: Dec. 11, 2018

(54) ELECTRICAL CONNECTOR WITH AN INSULATING BODY INTEGRAL WITH A HOUSING

(71) Applicant: DELTA ELECTRONICS, INC., Taoyuan (TW)

(72) Inventor: Jui-Ting Hsu, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 15/784,425

(22) Filed: Oct. 16, 2017

Related U.S. Application Data

(60) Provisional application No. 62/514,287, filed on Jun. 2, 2017.

(30) Foreign Application Priority Data

Sep. 20, 2017 (TW) ..... 106132320 A

(51) Int. Cl.

| | |
|---|---|
| ***H01R 27/02*** | (2006.01) |
| ***H01R 33/00*** | (2006.01) |
| ***H01R 33/94*** | (2006.01) |
| ***H01R 13/52*** | (2006.01) |
| ***H01R 13/506*** | (2006.01) |

(52) U.S. Cl.
CPC ..... *H01R 33/94* (2013.01); *H01R 13/506* (2013.01); *H01R 13/5213* (2013.01)

(58) Field of Classification Search
CPC ..... H01R 13/04; H01R 13/10; H01R 13/64; H01R 24/00; H01R 33/00; H01R 23/02
USPC ..... 439/76.1, 535, 638; 200/297; 174/53
See application file for complete search history.

(56) References Cited

U.S. PATENT DOCUMENTS

| | | | | |
|---|---|---|---|---|
| 6,089,924 | A * | 7/2000 | Wang | H01R 13/504 439/484 |
| 6,165,006 | A * | 12/2000 | Yeh | H01R 13/6641 439/490 |
| 7,344,385 | B2 * | 3/2008 | Chen | H05K 3/32 439/131 |
| 7,354,286 | B1 * | 4/2008 | Lee | H01R 13/652 439/131 |
| 7,798,825 | B1 * | 9/2010 | Pai | H01R 31/06 439/131 |
| 8,123,528 | B2 * | 2/2012 | Devlin | H01R 35/04 439/21 |
| 8,790,124 | B2 * | 7/2014 | Lee | H01R 13/642 439/131 |
| 9,325,098 | B2 * | 4/2016 | Chen | H01R 13/44 |

(Continued)

*Primary Examiner* — Chandrika Prasad
(74) *Attorney, Agent, or Firm* — Kirton McConkie; Evan R. Witt

(57) ABSTRACT

The present disclosure provides a power adapter including a first housing, a second housing, a circuit board, an electrical connector and a power cord. The first housing and the second housing are assembled together and define an interior space. The circuit board is accommodated in the interior space. The electrical connector is electrically connected with the circuit board and includes an insulation body and plural pins. The insulation body comprises a concave and a bottom wall, and the insulation body and the first housing are integrally formed into one piece. Each pin is partially located in the concave, partially embedded in the bottom wall, and partially extended outwardly from the bottom wall. The power cord is electrically connected with the circuit board.

20 Claims, 10 Drawing Sheets

(56) References Cited

U.S. PATENT DOCUMENTS

| | | | | |
|---|---|---|---|---|
| 2006/0110963 | A1* | 5/2006 | Cheng | H01R 13/6675<br>439/171 |
| 2017/0047691 | A1* | 2/2017 | Lin | H01R 13/6585 |

* cited by examiner

2

ELECTRICAL CONNECTOR WITH AN INSULATING BODY INTEGRAL WITH A HOUSING

CROSS-REFERENCE TO RELATED APPLICATION

This application claims the benefit of U.S. Provisional Application No. 62/514,287 filed on Jun. 2, 2017, entitled "SLIM POWER ADAPTER AND ELECTRICAL CONNECTOR MODULE THEREOF", and claims the priority of Taiwan Patent Application No. 106132320 filed on Sep. 20, 2017, the entirety of which are hereby incorporated by reference.

FIELD OF THE DISCLOSURE

The present disclosure relates to a power adapter, and more particularly to a slim power adapter and an electrical connector module thereof.

BACKGROUND OF THE DISCLOSURE

Power adapter is a power supply widely used in our daily life for converting and providing power to electrical appliances. For being applied to various conditions, generally, the power adapter has a special structure design for assembling. FIG. 1A is an exploded view illustrating a conventional power adapter, and FIG. 1B is a perspective view illustrating the power adapter of FIG. 1A. As shown in FIGS. 1A and 1B, the power adapter 1 includes an upper housing 11, a lower housing 12, a circuit board 13, an electrical connector 14 and a power cord 15. The upper housing 11 and the lower housing 12 are assembled together to define an accommodation space for accommodating the circuit board 13. The electrical connector 14 and the power cord 15 are electrically connected with the circuit board 13 separately and retained by the upper housing 11 and the lower housing 12. A first recess 111 and a second recess (not shown) are respectively formed on the front side and the rear side of the upper housing 11. A third recess 121 and a fourth recess 122 are respectively formed on the front side and the rear side of the lower housing 12. When the upper housing 11 and the lower housing 12 are assembled together, a first hole is defined by the first recess 111 and the third recess 121 for fixing and retaining the electrical connector 14 and a second hole is defined by the second recess and the fourth recess 122 for fixing and retaining a fixing portion 151 of the power cord 15.

The electrical connector 14 includes an insulation body 141 and plural pins 142. The insulation body 141 has an engaging part 143 and a concave 144. The engaging part 143 is extended outwardly from the peripheral surface of the insulation body 141 at the front end. The engaging part 143 has a groove 145 corresponding to the rim of the first recess 111 and the rim of the third recess 121. The pins 142 are located in the concave 144 inside the insulation body 141. Generally, the upper housing 11, the lower housing 12 and the electrical connector 14 are assembled together by ultrasonic welding technology. Since the electrical connector 14 is independent from the upper housing 11 and the lower housing 12, the engaging part 143 of the electrical connector 14 is necessary for engaging with the rim of the first recess 111 and the rim of the third recess 121. Consequently, the electrical connector 14 is fixed in the first hole. However, the above-mentioned engaging structure causes the additional volume of the electrical connector 14 and further affects the dimensions of the power adapter 1. Especially, the thickness h of the power adapter 1 can't be reduced because of the specific size of the electrical connector 14. Namely, the thickness of the power adapter 1 is limited by the size and profile of the electrical connector 14. Consequently, the thinning and the miniaturization of the power adapter 1 are affected. In addition, the power adapter 1 is not easy to be assembled.

Therefore, there is a need of providing a power adapter and an electrical connector module thereof to obviate the drawbacks encountered from the prior arts.

SUMMARY OF THE DISCLOSURE

It is an object of the present disclosure to provide a slim power adapter and an electrical connector module thereof. By using the inventive power adapter, the insulation body of the electrical connector and the first housing are integrally formed into one piece by injection molding without using engaging structure, so that the thickness of the power adapter is reduced. Consequently, the power adapter of the present disclosure is miniaturized and slimmer. In addition, the power adapter is easy to be assembled.

In accordance with one aspect of the present disclosure, the present disclosure provides a power adapter including a first housing, a second housing, a circuit board, an electrical connector and a power cord. The first housing and the second housing are assembled together and define an interior space. The circuit board is accommodated in the interior space. The electrical connector is electrically connected with the circuit board and includes an insulation body and plural pins. The insulation body comprises a concave and a bottom wall, and the insulation body and the first housing are integrally formed into one piece. Each pin is partially located in the concave, partially embedded in the bottom wall, and partially extended outwardly from the bottom wall. The power cord is electrically connected with the circuit board.

In accordance with another aspect of the present disclosure, the present disclosure further provides an electrical connector module including a first housing and an electrical connector. The electrical connector includes an insulation body and plural pins. The insulation body comprises a concave and a bottom wall, and the insulation body and the first housing are integrally formed into one piece. Each pin is partially located in the concave, partially embedded in the bottom wall, and partially extended outwardly from the bottom wall.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1A:
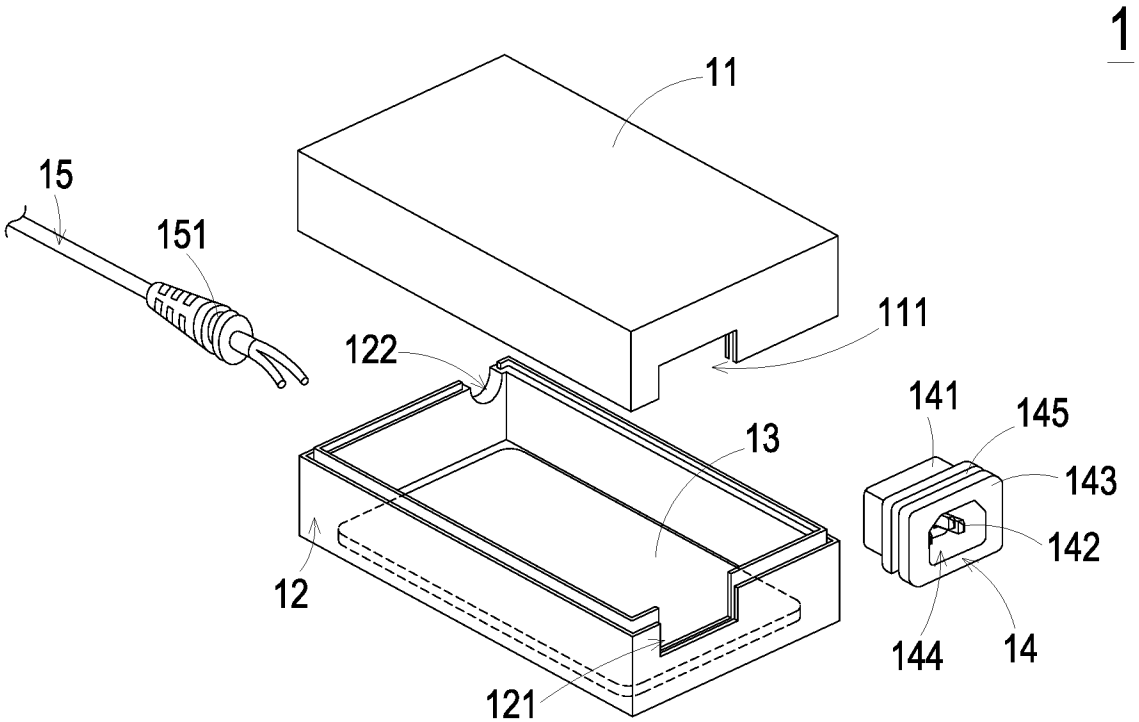
FIG. 1A (PRIOR ART)
FIG. 1A is an exploded view illustrating a conventional power adapter.
Figure 1B:
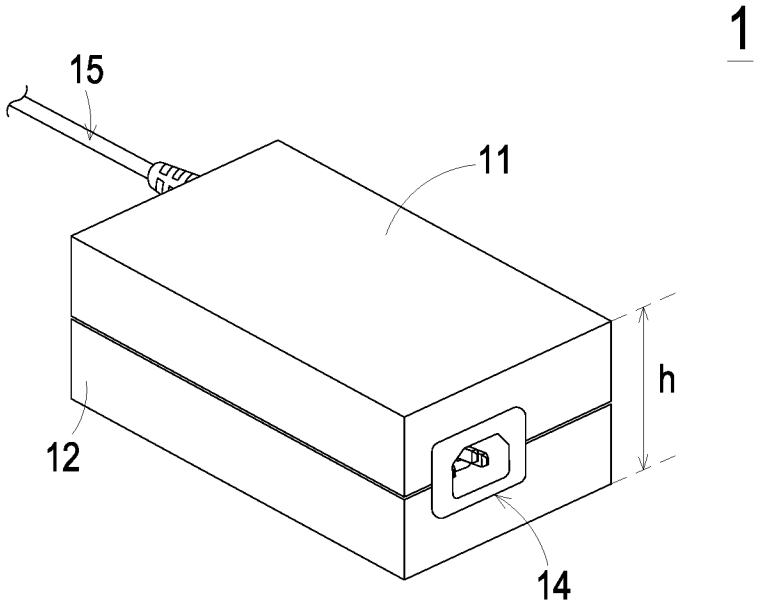
FIG. 1B (PRIOR ART)
FIG. 1B is a perspective view illustrating the power adapter of FIG. 1A.
Figure 2B:
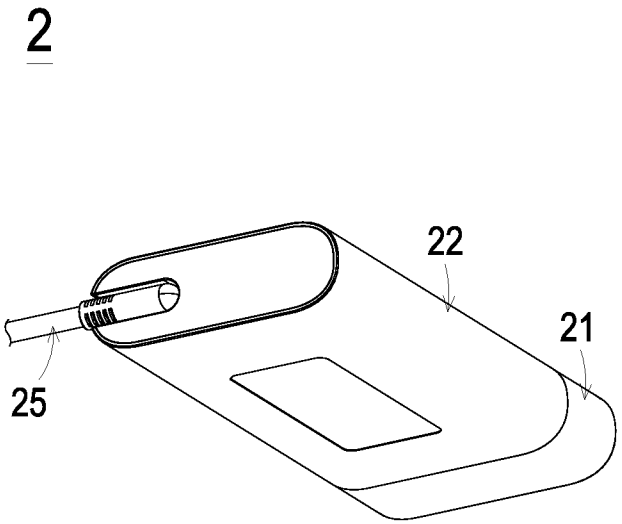
FIG. 2B is a rear, bottom, left-side perspective view illustrating the power adapter of FIG. 2A.
Figure 2A:
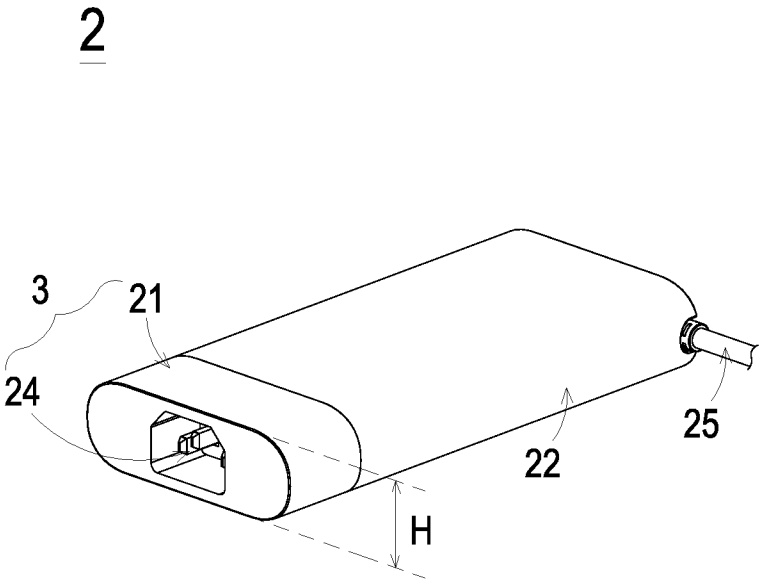
FIG. 2A is a front, top, right-side perspective view illustrating a power adapter according to a first embodiment of the present disclosure.
Figure 3A:
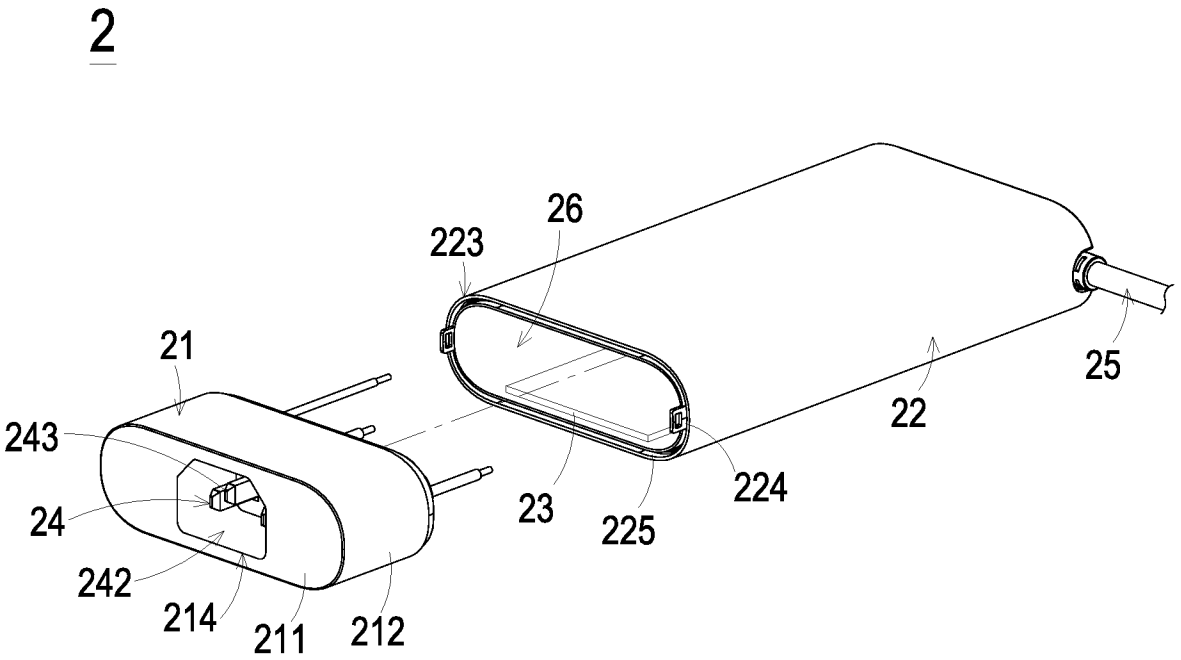
FIG. 3A is an exploded view illustrating the power adapter of FIG. 2A.
Figure 3B:
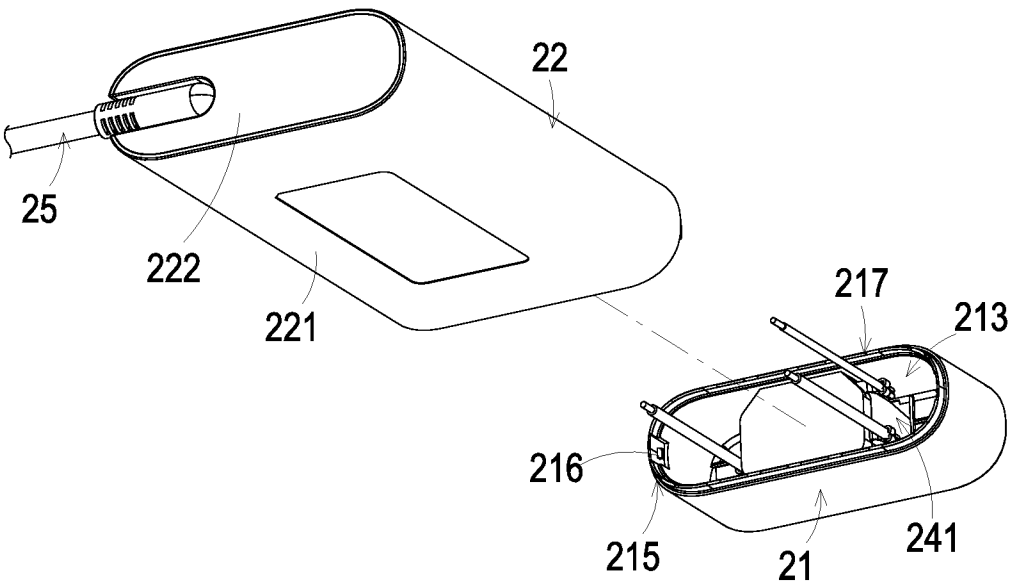
FIG. 3B is an exploded view illustrating the power adapter of FIG. 2A at another view angle.

FIG. 2A is a front, top, right-side perspective view illustrating a power adapter according to a first embodiment of the present disclosure. FIG. 2B is a rear, bottom, left-side perspective view illustrating the power adapter of FIG. 2A. FIG. 3A is an exploded view illustrating the power adapter of FIG. 2A. FIG. 3B is an exploded view illustrating the power adapter of FIG. 2A at another view angle. As shown in FIGS. 2A, 2B, 3A and 3B, the power adapter 2 of the present disclosure includes a first housing 21, a second housing 22, a circuit board 23, an electrical connector 24 and a power cord 25. The first housing 21 and the second housing 22 are assembled together to define an interior space 26 for accommodating the circuit board 23. The electric connector 24 is electrically connected with the circuit board 23 and includes an insulation body 241 and plural pins 243. Each pin 243 is separated from the others and partially embedded in the insulation body 241. The power cord 25 is electrically connected with the circuit board 23. In this embodiment, the first housing 21 and the electrical connector 24 form an electrical connector module 3. The first housing 21 and the insulation body 241 of the electrical connector 24 are integrally formed into one piece without using any engaging structure. Consequently, the thickness H of the power adapter 2 is reduced. Preferably, the thickness H of the power adapter 2 is equal to or less than 23 mm. In an embodiment, the first housing 21 is integrally formed into one piece with the insulation body 241 by injection molding By using the inventive power adapter, the insulation body 241 of the electrical connector 24 and the first housing 21 are integrally formed into one piece by injection molding without using engaging structure. Compare with the conventional power adapter assembling the electrical connector with the housing by engaging structure, the present disclosure can eliminates the thickness of the engaging structure and therefore reduces the thickness of the power adapter. Consequently, the power adapter of the present disclosure is miniaturized and thinned. In addition, the power adapter is easy to be assembled.

Figure 4:
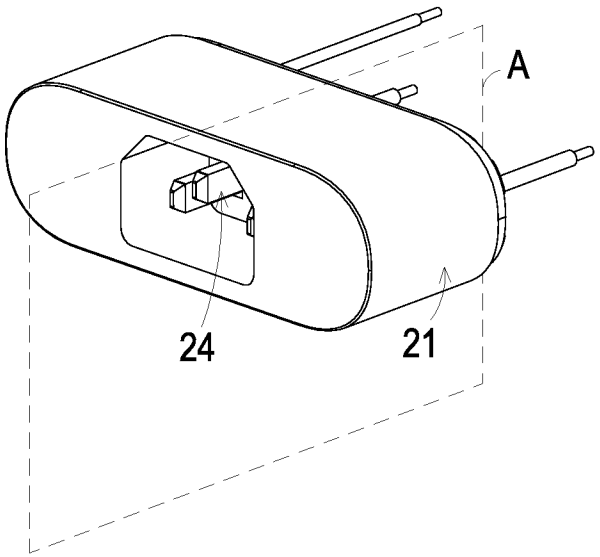
FIG. 4 is a perspective view illustrating the combination of the first housing and the electrical connector of FIG. 2A.
Figure 5:
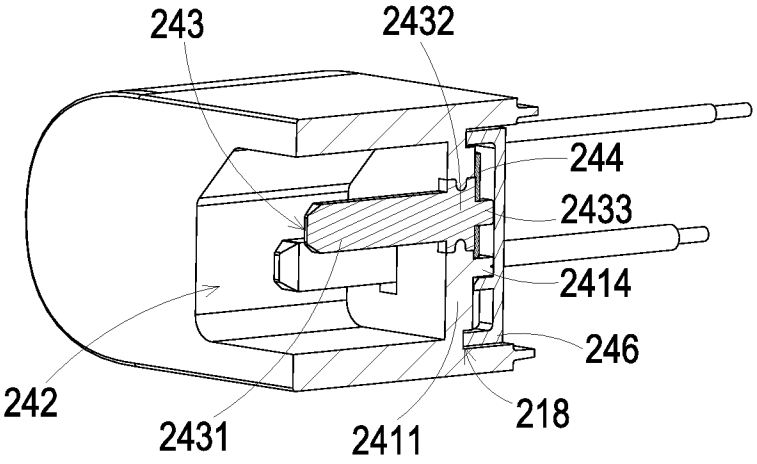
FIG. 5 is a cross-sectional view taken along the plane A of FIG. 4.

FIG. 4 is a perspective view illustrating the combination of the first housing and the electrical connector of FIG. 2A. FIG. 5 is a cross-sectional view taken along the plane A of FIG. 4. As shown in FIGS. 3A, 3B, 4 and 5, the first housing 21 includes a front panel 211, a sidewall 212 and an accommodation space 213. The front panel 211 has an opening 214. The sidewall 212 is extended axially from an outer periphery of the front panel 211. The accommodation space 213 is defined by the front panel 211 and the sidewall 212. The insulation body 241 of the electrical connector 24 is connected with the front panel 211 and located in the accommodation space 213 of the first housing 21. In this embodiment, the insulation body 241, the first panel 211 and the sidewall 212 are integrally formed into one piece. In addition, the insulation body 241 of the electrical connector 24 includes a concave 242. The concave 242 is coupled with the opening 214 of the front panel 211 and aligned with the opening 214 of the front panel 211. Every pin 243 is partially disposed in the concave 242, partially embedded in the bottom wall 2411 of the insulation body 241, and partially penetrated through and extended outwardly from the bottom wall 2411. In an embodiment, each pin 243 includes a first part 2431, a fixing part 2432 and a second part 2433. The fixing part 2432 is connected between the first part 2431 and the second part 2433. The first part 2431 of the pin 243 is accommodated in the concave 242. The fixing part 2432 of the pin 243 is embedded in the bottom wall 2411 of the insulation body 241. The second part 2433 of the pin 243 is extended outwardly from the bottom wall 2411 and accommodated in the accommodation space 213. In this embodiment, the electrical connector 24 is a C14 connector conforming to the IEC 60320 standard. The plural pins 243 of the electrical connector 24 includes two power pins and one ground pin, and the opening 214 of the front panel 211 is in hexagon shape.

Figure 6:
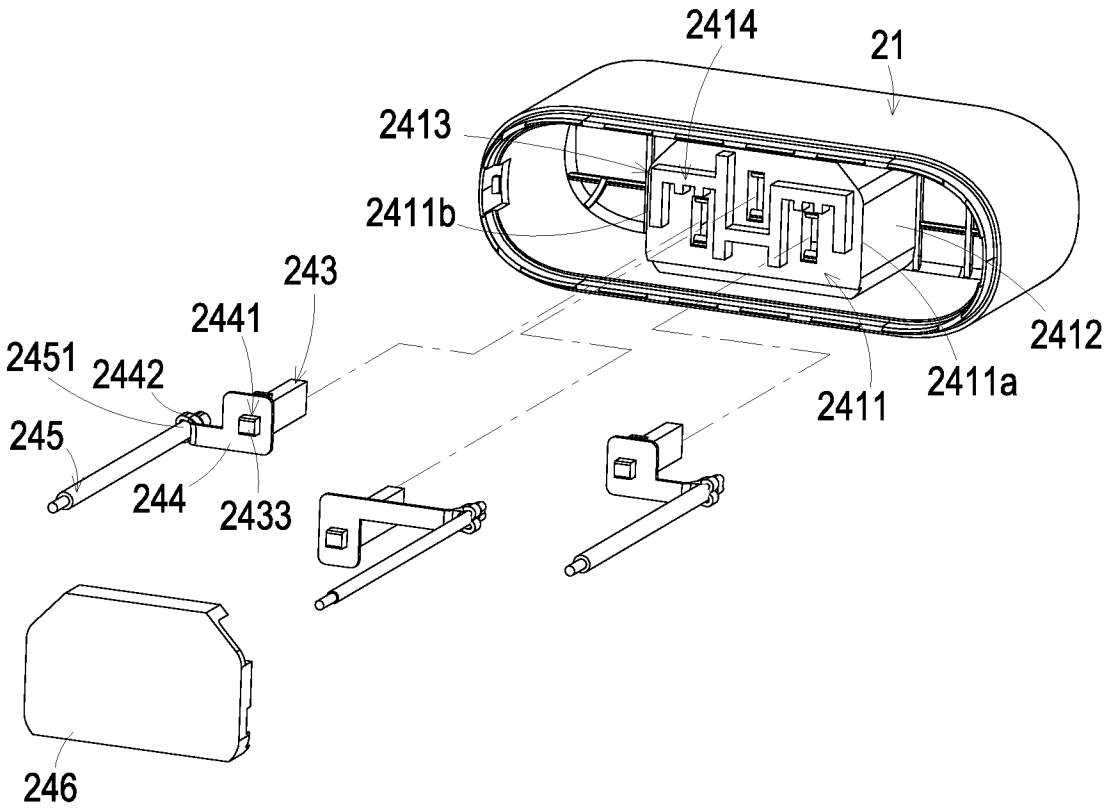
FIG. 6 is an exploded view illustrating the combination of the first housing and the electrical connector of FIG. 4 at another view angle.

FIG. 6 is an exploded view illustrating the combination of the first housing and the electrical connector of FIG. 4 at another view angle. As shown in FIGS. 3A, 3B, 4, 5 and 6, the insulation body 241 includes a bottom wall 2411, a first sidewall 2412 and a second sidewall 2413 opposite to the first sidewall 2412. The concave 242 is defined by the bottom wall 2411, the first sidewall 2412 and the second sidewall 2413 of the insulation body 241 and the front panel 211 and the sidewall 212 of the first housing 21. The bottom wall 2411 includes a first edge 2411*a* and a second edge 2411*b*. The first edge 2411*a* is opposite to the second edge 2411*b*. The second part 2433 of the pin 243 is protruded from the bottom wall 2411 and toward the accommodation space 213.

The electrical connector 24 further includes plural conductive pieces 244 and plural wires 245. The plural conductive pieces 244 are respectively corresponding to the plural pins 243, for example the three conductive pieces 244 corresponding to the three pins 243 as shown in FIG. 6. For each conductive piece 244, one terminal of the conductive piece 244 has an aperture 2441, and the second part 2433 of the corresponding pin 243 is penetrated through the aperture 2441 of the conductive piece 244, so that the pin 243 and the conductive piece 244 are connected with each other by riveting. The conductive piece 244 is located in the accommodation space 213 and attached on the bottom wall 2411. Moreover, the conductive piece 244 is extended along the bottom wall 2411 and toward the first edge 2411*a* or the second edge 2411*b*. The other terminal of the conductive piece 244 has a clamping element 2442, and a bare part 2451 of the wire 245 is clamped by the clamping element 2442, so that the wire 245 is connected with the conductive piece 244. Preferably but not exclusively, the clamping element 2442 is close to the first sidewall 2412 or the second sidewall 2413. Since the wire 245 is electrically connected with the circuit board 23, the pin 243 is electrically connected with the circuit board 23 via the conductive piece 244 and the wire 245. In an embodiment, two conductive pieces 244 corresponding to two power pins 243 are attached on the bottom wall 2411, and extended toward the first edge 2411*a* and second edge 2411*b* separately. Namely, two conductive pieces 243 respectively corresponding to two power pins 243 are extended along the bottom wall 2411 and toward the opposite direction. The conductive piece 244 corresponding to the ground pin 243 is attached on the bottom wall 2411 and extended along the bottom wall 2411 toward the first edge 2411*a* or the second edge 2411*b*.

In an embodiment, the insulation body 241 further includes plural projections 2414 protruded from the outer surface of the bottom wall 2411. The projections 2414 forms plural retaining structures for limiting the position of the conductive piece 244 when the second part 2433 of the pin 243 is coupled with the conductive piece 244. Consequently, the conductive pieces 244 can be securely fixed and located on the bottom wall 2411, and the conductive pieces 244 are separated from each other.

For achieving the thinning and the miniaturization of the power adaptor 2, the first housing 21 and the electrical connector 24 are integrally formed into one piece by injection molding, preferably insert molding. First, plural pins 243 are provided, and the pins 243 are placed into the mold. Subsequently, the molding material, such as plastic, is injected into the mold to form the first housing 21 and the insulation body 241 of the electrical connector 24, and meanwhile, the fixing part 2432 of each pin 243 is embedded in the bottom wall 2411 of the insulation body 241, which is integrally formed into one piece with the first housing 21. Afterwards, plural conductive pieces 244 and plural wires 245 are provided, each wire 245 is clamped by the clamping element 2442 of the corresponding conductive piece 244, and then each conductive piece 244 are connected with the corresponding pin 243 by riveting, and the conductive pieces 244 are attached on the bottom wall 2411 and retained in the retaining structures formed by the projections 2414.

Since the first housing 21 and the insulation body 241 are integrally formed into one piece, no engaging structure is needed for fixing the electrical connector 24 on the first housing 21. Therefore, the thickness H of the power adaptor 2 can be reduced, and the time and laboring for fixing the electrical connector 24 on the first housing 21 can be eliminated. Further, since the fixing parts 2432 of the pins 243 are embedded in the one piece structure of the first housing 21 and the insulation body 241, there is no interstice between the pins 234 and the first housing 21. Namely, the waterproof structure is formed, and thus the power adapter 2 is waterproof.

Please refer to FIGS. 3A and 3B again. The second housing 22 includes a sleeve 221 and a bottom panel 222 connected with the sleeve 221. In an embodiment, the first housing 21 includes a first connection portion 215, and the second housing 22 includes a second connection portion 223 corresponding to the first connection portion 215 of the first housing 21. In addition, the first connection portion 215 includes plural first buckling elements 216. For example but not limited to the two first buckling elements 216, and the two first buckling elements 216 are located at two sides of the first connection portion 215 respectively. The second connection portion 223 includes plural second buckling elements 224. For example but not limited to the two second buckling elements 224, and the two second buckling elements 224 are corresponding to the two first buckling elements 216 respectively. When the first buckling elements 216 and the second buckling elements 224 are fastened with each other, the first housing 21 is coupled with the second housing 22. Moreover, the second connection portion 223 includes a slot 225, and the first connection portion 215 includes plural flanges 217 corresponding to the slot 225. When the first connection portion 215 of the first housing 21 is coupled with the second connection portion 223 of the second housing 22 by ultrasonic welding, the plural flanges 217 are inserted into the slot 225. Consequently, the coupling between the first housing 21 and the second housing 22 becomes more stable. In addition, the second housing 22 includes a hole for accommodating a terminal of the power cord 25, and the position of the hole is not limited by that shown in FIG. 3B.

Please refer to FIG. 5 again. When the first housing 21 and the insulation body 241 of the electrical connector 24 are formed into one piece by injection molding, the great variation of the wall thickness may cause flow mark formed on the outside surface. In order to address the injection molding defects, the first housing 21 further includes plural dents 218 located near the connection portion of the sidewall 212 of the first housing 21 and the bottom wall 2411 of the insulation body 241 for preventing the injection molding from causing the flow mark on the outside surface of the sidewall 212.

In an embodiment, the electrical connector 24 further includes an insulation cover 246. The insulation cover 246 is fastened on the bottom wall 2411 of the insulation body 241 and located in the accommodation space 213. The insulation cover 246 is used for covering the pins 243 and the conductive pieces 244 and protecting the pins 243 via the insulation characteristic of the insulation cover 246.

Figure 7:
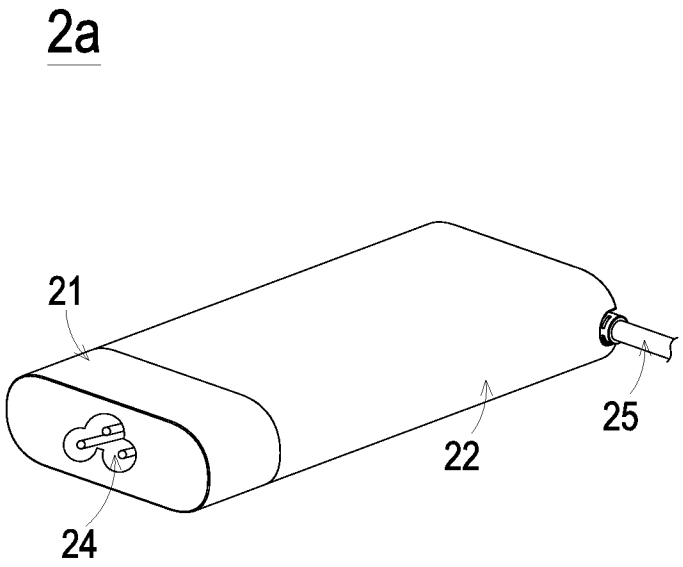
FIG. 7 is a perspective view illustrating a power adapter according to a second embodiment of the present disclosure.
Figure 8:
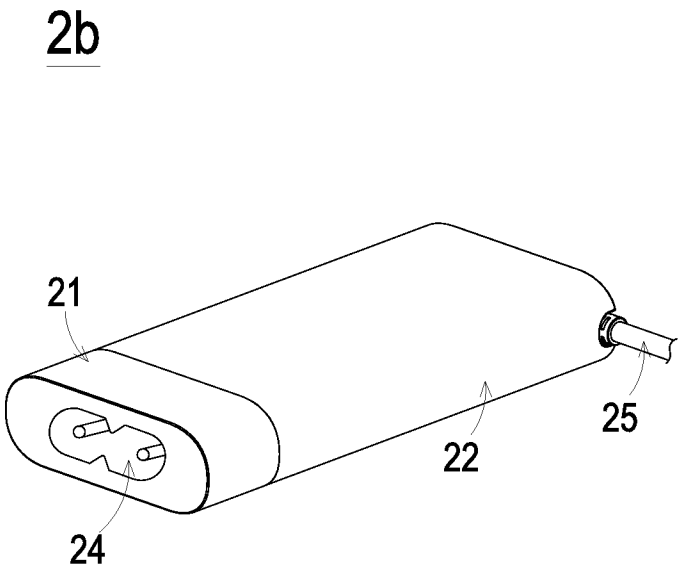
FIG. 8 is a perspective view illustrating a power adapter according to a third embodiment of the present disclosure.

In the above embodiment, the electrical connector 24 is a C14 connector conforming to the IEC 60320 standard. The plural pins 243 of the electrical connector 24 includes two power pins and one ground pin, and the opening 214 of the first panel 211 is in hexagon shape. The electrical connector 24 is not limited to C14 connector. FIG. 7 is a perspective view illustrating a power adapter according to a second embodiment of the present disclosure. FIG. 8 is a perspective view illustrating a power adapter according to a third embodiment of the present disclosure. It is noted that the amount of the pins 243 and the shape of the opening 214 can be varied according to the practical requirements. For example, the electrical connector 24 of the power adapter 2*a* can be a C6 connector conforming to the IEC 60320 standard (as shown in FIG. 7), or the electrical connector 24 of the power adapter 2*b* can be C8 connector conforming to the IEC 60320 standard (as shown in FIG. 8).

From the above descriptions, the present disclosure provides a slim power adapter and an electrical connector module thereof. By using the inventive power adapter, the first housing and the insulation body of the electrical connector are integrally formed into one piece by injection molding without using engaging structure, so that the thickness of the power adapter is reduced. Consequently, the power adapter of the present disclosure is miniaturized and slimmer. In addition, the power adapter is easy to be assembled.

While the disclosure has been described in terms of what is presently considered to be the most practical and preferred embodiments, it is to be understood that the disclosure needs not be limited to the disclosed embodiment.

What is claimed is:

1. A power adapter, comprising:

a first housing;

a second housing, wherein the first housing and the second housing are assembled together and define an interior space;

a circuit board accommodated in the interior space;

an electrical connector electrically connected with the circuit board, the electrical connector comprising:

an insulation body comprising a concave and a bottom wall, wherein the insulation body and the first housing are integrally formed into one piece; and plural pins, wherein each pin is partially located in the concave, partially embedded in the bottom wall, and partially extended outwardly from the bottom wall; and a power cord electrically connected with the circuit board.

2. The power adapter according to claim 1, wherein the first housing comprises a front panel, a sidewall and an accommodation space, the accommodation space is defined by the front panel and the sidewall, wherein the insulation body is coupled with the front panel and located in the accommodation space.

3. The power adapter according to claim 2, wherein each pin comprises a first part accommodated in the concave, a fixing part embedded in the bottom wall, and a second part extended outwardly from the bottom wall and located in the accommodation space, wherein the fixing part is coupled between the first part and the second part.

4. The power adapter according to claim 3, wherein the front panel comprises an opening, the opening of the front panel is coupled with and aligned with the concave of the electrical connector.

5. The power adapter according to claim 3, wherein the electrical connector comprises:

plural wires electrically coupled with the circuit board, wherein each wire comprises a bare part; and plural conductive pieces respectively corresponding to the plural pins and attached on the bottom wall, wherein each conductive piece comprises an aperture and a clamping element, the aperture is coupled with the second part of the corresponding pin, and the clamping element clamps the bare part of the corresponding wire.

6. The power adapter according to claim 5, wherein the electrical connector comprises an insulation cover fastened on the bottom wall, and the insulation cover covers the plural pins and the plural conductive pieces.

7. The power adapter according to claim 5, wherein the insulation body comprises plural projections protruded from the bottom wall for retaining the plural conductive pieces on the bottom wall and separating the plural conductive pieces from each other.

8. The power adapter according to claim 5, wherein the bottom wall of the insulation body comprises a first edge and a second edge opposite to the first edge, and each conductive piece is attached on and extended along the bottom wall and toward the first edge or the second edge, wherein the insulation body comprises a first sidewall and a second sidewall opposite to the first sidewall, and each clamping element of the conductive piece is close to the first sidewall or the second sidewall.

9. The power adapter according to claim 2, wherein the insulation body and the first housing are integrally formed by an injection molding, the first housing comprises plural dents located near a connection portion of the sidewall of the first housing and the bottom wall of the insulation body.

10. The power adapter according to claim 1, wherein the first housing comprises a first connection portion, the second housing comprises a second connection portion corresponding to the first connection portion, wherein the first connection portion comprises plural first buckling elements, the second connection portion comprises plural second buckling elements corresponding to the plural first bucking elements, and the plural first buckling element and the plural second buckling element are fastened with each other respectively for coupling the first housing with the second housing.

11. The power adapter according to claim 10, wherein the second connection portion comprises a slot, the first connection portion comprises plural flanges corresponding to the slot, wherein the first connection portion is coupled with the second connection portion, and the flanges are embedded in the slot.

12. The power adapter according to claim 1, wherein the electrical connector is a C6 connector, a C8 connector or a C14 connector conforming to the IEC 60320 standard.

13. The power adapter according to claim 1, wherein the power adapter has a specific thickness, and the specific thickness is less than 23 mm.

14. An electrical connector module, comprising:

a first housing; and an electrical connector comprising:

an insulation body comprising a concave and a bottom wall, wherein the insulation body and the first housing are integrally formed into one piece; and plural pins, wherein each pin is partially located in the concave, partially embedded in the bottom wall, and partially extended outwardly from the bottom wall.

15. The electrical connector module according to claim 14, wherein the first housing comprises a front panel, a sidewall and an accommodation space, the accommodation space is defined by the front panel and the sidewall, wherein the insulation body is coupled with the front panel and located in the accommodation space.

16. The electrical connector module according to claim 15, wherein each pin comprises a first part accommodated in the concave, a fixing part embedded in the bottom wall, and a second part extended outwardly from the bottom wall and located in the accommodation space, wherein the fixing part is coupled between the first part and the second part.

17. The electrical connector module according to claim 16, wherein the front panel comprises an opening, the opening of the front panel is coupled with and aligned with the concave of the electrical connector.

18. The electrical connector module according to claim 16, wherein the electrical connector comprises:

plural wires electrically coupled with the circuit board, wherein each wire comprises a bare part; and plural conductive pieces respectively corresponding to the plural pins and attached on the bottom wall, wherein each conductive piece comprises an aperture and a clamping element, the aperture is coupled with the second part of the corresponding pin, and the clamping element clamps the bare part of the corresponding wire.

19. The electrical connector module according to claim 18, wherein the electrical connector comprises an insulation cover fastened on the bottom wall, and the insulation cover covers the plural pins and the plural conductive pieces.

20. The electrical connector module according to claim 14, wherein the electrical connector is a C6 connector, a C8 connector or a C14 connector conforming to the IEC 60320 standard.

* * * * *